US011937697B1

(12) United States Patent
Comer et al.

(10) Patent No.: US 11,937,697 B1
(45) Date of Patent: Mar. 26, 2024

(54) XCHANGE MECHANISM TABLE MOUNT SYSTEM AND METHOD OF USE

(71) Applicants: Randy Comer, Plano, TX (US); Charlie Prenzi, Plano, TX (US)

(72) Inventors: Randy Comer, Plano, TX (US); Charlie Prenzi, Plano, TX (US)

( * ) Notice: Subject to any disclaimer, the term of this patent is extended or adjusted under 35 U.S.C. 154(b) by 39 days.

(21) Appl. No.: 17/505,450

(22) Filed: Oct. 19, 2021

Related U.S. Application Data

(63) Continuation-in-part of application No. 17/505,425, filed on Oct. 19, 2021, now abandoned, which is a continuation of application No. 17/239,368, filed on Apr. 23, 2021, now abandoned.

(60) Provisional application No. 63/040,838, filed on Jun. 18, 2020.

(51) Int. Cl.
*A47B 97/00* (2006.01)

(52) U.S. Cl.
CPC ..... *A47B 97/00* (2013.01); *A47B 2200/0084* (2013.01)

(58) Field of Classification Search
CPC ..... A47B 97/00; A47B 2200/0084; A47B 2200/0088; A47B 37/04; A47B 13/16
USPC ..... 108/50.01, 50.02, 50.12, 50.11, 31, 28, 108/23, 29
See application file for complete search history.

(56) References Cited

U.S. PATENT DOCUMENTS 361,267 A * 4/1887 Conn ..... A47B 61/00 362/132
560,541 A * 5/1896 Richards ..... A47B 37/00 108/50.11
910,767 A * 1/1909 Allert ..... A47B 27/00 108/29
1,104,103 A * 7/1914 Carpenter ..... A47B 37/00 108/50.11
2,127,124 A * 8/1938 Litner ..... F21V 17/14 362/448
2,268,831 A * 1/1942 William ..... H01R 13/748 439/527
2,339,495 A * 1/1944 McMann ..... D06F 79/026 219/242
2,589,719 A * 3/1952 McKinney ..... A47B 11/00 108/154
3,361,508 A * 1/1968 Chassevent ..... A47B 21/06 312/283
4,584,946 A * 4/1986 Tucker ..... A47B 37/04 108/128
4,751,620 A * 6/1988 Wright ..... B43L 3/001 362/396
11,129,471 B1 * 9/2021 Oglesby ..... A47B 13/023
2005/0022699 A1 * 2/2005 Goza ..... A47B 21/0314 108/50.01
2015/0245704 A1 * 9/2015 Hwang ..... A47B 11/00 108/91
2020/0390235 A1 * 12/2020 Lan ..... F16M 13/022
2020/0393078 A1 * 12/2020 Kim ..... F16M 11/18

* cited by examiner

*Primary Examiner* — Jose V Chen
(74) *Attorney, Agent, or Firm* — LEAVITT & ELDREDGE; Richard Eldredge

(57) ABSTRACT

A table mount system attached one of various accessories to a table by a central mount. The accessories could be attached to a stand to elevate them over the table. The mount has a mount body and a mount plate that hold the table between them to provide a secure anchor to which the accessories are attached.

1 Claim, 8 Drawing Sheets

XCHANGE MECHANISM TABLE MOUNT SYSTEM AND METHOD OF USE

BACKGROUND

1. Field of the Invention

The present invention relates generally to furniture systems, and more specifically, to a table mount system that enables the rapid placement of appliances or accouterments on a table to enhance the use of the table.

2. Description of Related Art

Furniture systems are well known in the art and are effective means to provide places or rest or function to people. For example, tables are furniture that commonly have a flat surface and are held up off the ground by legs. Tables are commonly used to eat on, work at or otherwise hold items or objects. People commonly, congregate around a table and converse or otherwise socialize or interact. In particular, it is common to have a table outdoors at a home or at a hospitality or entertainment location. The table allows for eating, socializing or other activities out of doors. The environment out of doors can be improved through conveniences such as a heater, umbrella or the like.

One of the problems commonly associated with common furniture systems is their limited use. For example, when conveniences such as the heater or umbrella are implemented they are not easy to use, the heater commonly stands next to the table or away from it reducing its effectivity or creating an obstacle to the full use of the table. Likewise, umbrellas are commonly attached to the center of the table and when not in use create an obstacle to the use of the table.

Accordingly, although great strides have been made in the area of table accessory systems, many shortcomings remain.

DESCRIPTION OF THE DRAWINGS

The novel features believed characteristic of the embodiments of the present application are set forth in the appended claims. However, the embodiments themselves, as well as, a preferred mode of use, and further objectives and advantages thereof, will best be understood by reference to the following detailed description when read in conjunction with the accompanying drawings, wherein:

Figure 1A:
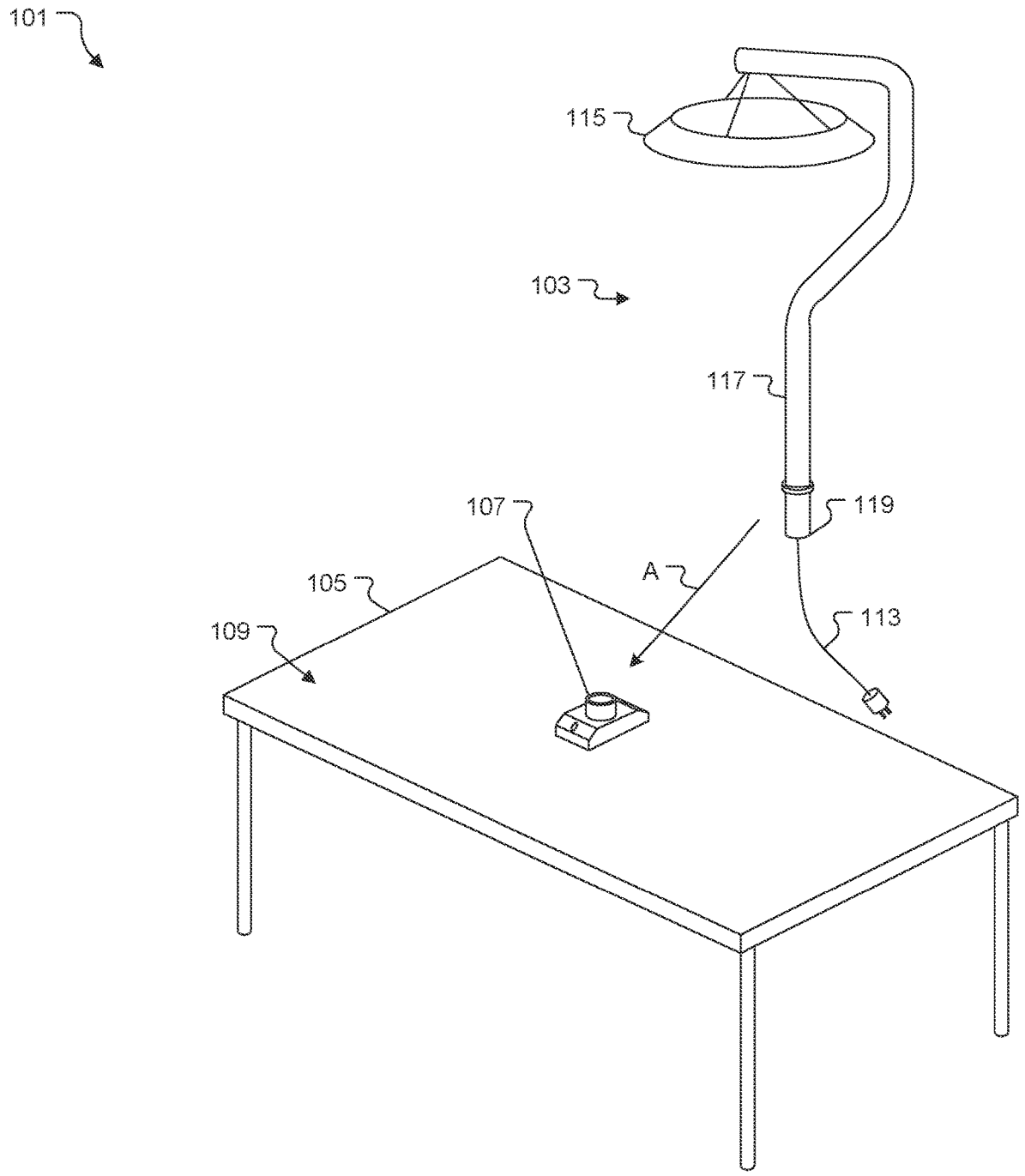
FIGS. 1A and 1B are front isometric views of a table mount system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional table accessory systems. Specifically, the present invention provides the means to rapidly change accessory attached to a table that augments its use. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 1B:
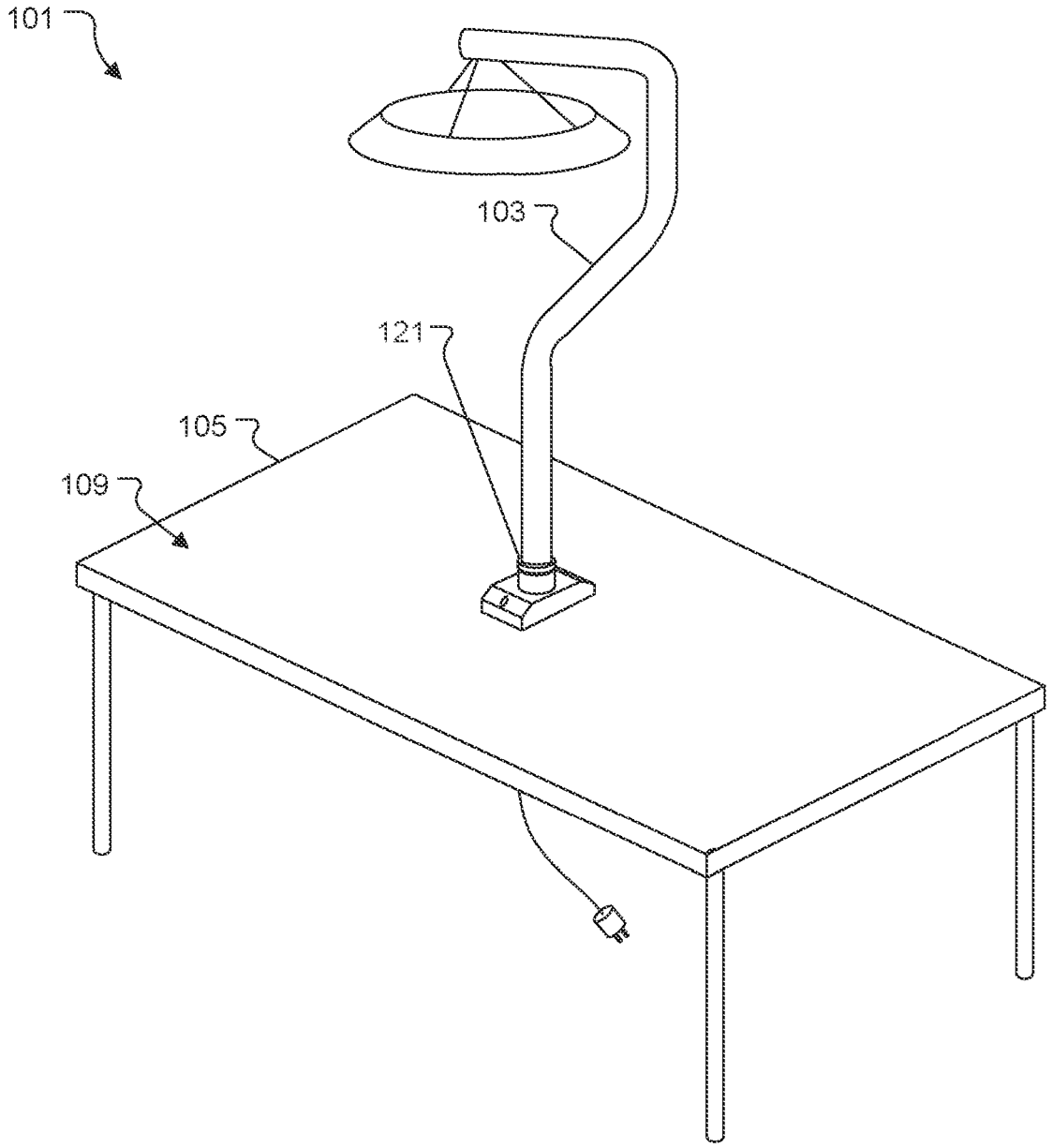

Referring now to the drawings wherein like reference characters identify corresponding or similar elements throughout the several views, FIGS. 1A and 1B depict front isometric views of a table mount system in accordance with a preferred embodiment of the present application. It will be appreciated that system 101 overcomes one or more of the above-listed problems commonly associated with conventional table accessory systems.

In the contemplated embodiment, system 101 includes a changeable accessory stand 103 and a mount 107 that is attached to and passes through the top surface 109 of a table 105. The changeable accessory stand 103 is configured to rest in and be supported by the mount 107. In this embodiment, the accessory is depicted as an electric heater with a power cord 113 extending from the electric heater 115 through a hollow pole 117 and out the bottom opening 119 thereof. The hollow pole 117 also includes a retaining ring 121 thereto a distance from the bottom opening 119 and is configured to allow the hollow pole 117 to enter the mount but not pass through it.

In use, the changeable accessory stand 103 is placed in the mount 107 as depicted by motion A where the power cord 113 passes through the mount 107 and table 105. The power cord 113 is connected to a power source and the electric heater 115 generates heat to those that congregate around the table 105.

While the changeable accessory stand 103 is depicted with an electric heater 115 it is contemplated that any accessory could be used with a changeable accessory stand in the mount 107.

Figure 2:
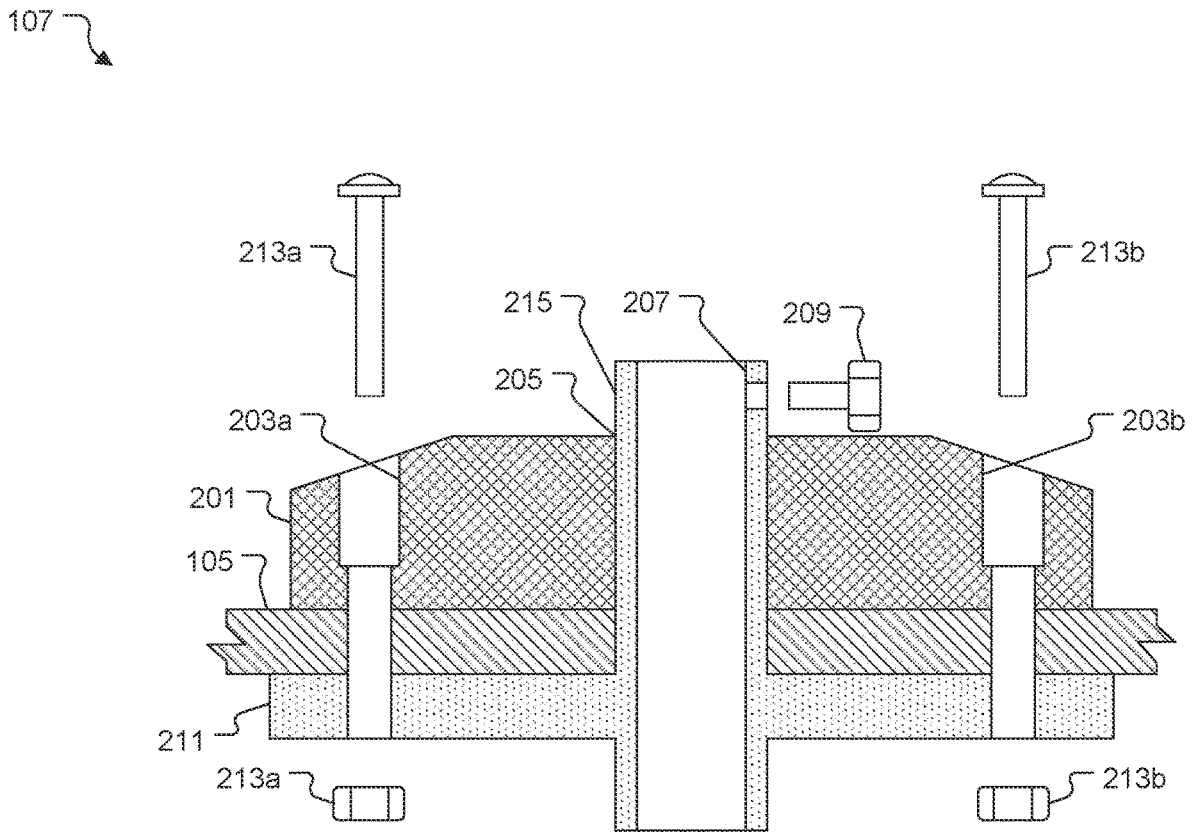
FIG. 2 is a cross-sectional front view of the mount of FIGS. 1A and 1B.

The mount 107 is further depicted by FIG. 2 and includes a mount body 201 that is configured to rest against the table 105 and hold it between a mounting plate 211. The mount body 201 and mounting plate 211 are secured together via fasteners 213 which are depicted as bolts with nuts. In this embodiment, the fasteners pass through holes 203 in the mount body 201.

The mounting plate 211 includes a central shaft 215 that extends away from the plate both upwards and downwards therefrom. The central shaft 215 is hollow 207 and acts as a tube. The mount body 201 also includes a passageway 205 that extends therethrough and allows the central shaft 215 to pass therethrough. The central shaft 215 includes an attachment device 209 that is configured to hold the changeable accessory stand 103 therein, depicted here as a set screw with a corresponding hole.

It should be appreciated that one of the unique features believed characteristic of the present application is that the mount 107 allows for the rapid exchange of one changeable accessory stand 103 for another. It will further be appreciated that the mount 107 attaches the changeable accessory stand 103 in the middle of the table 105 to minimize the obstruction around the edges or sides thereof.

Figure 3:
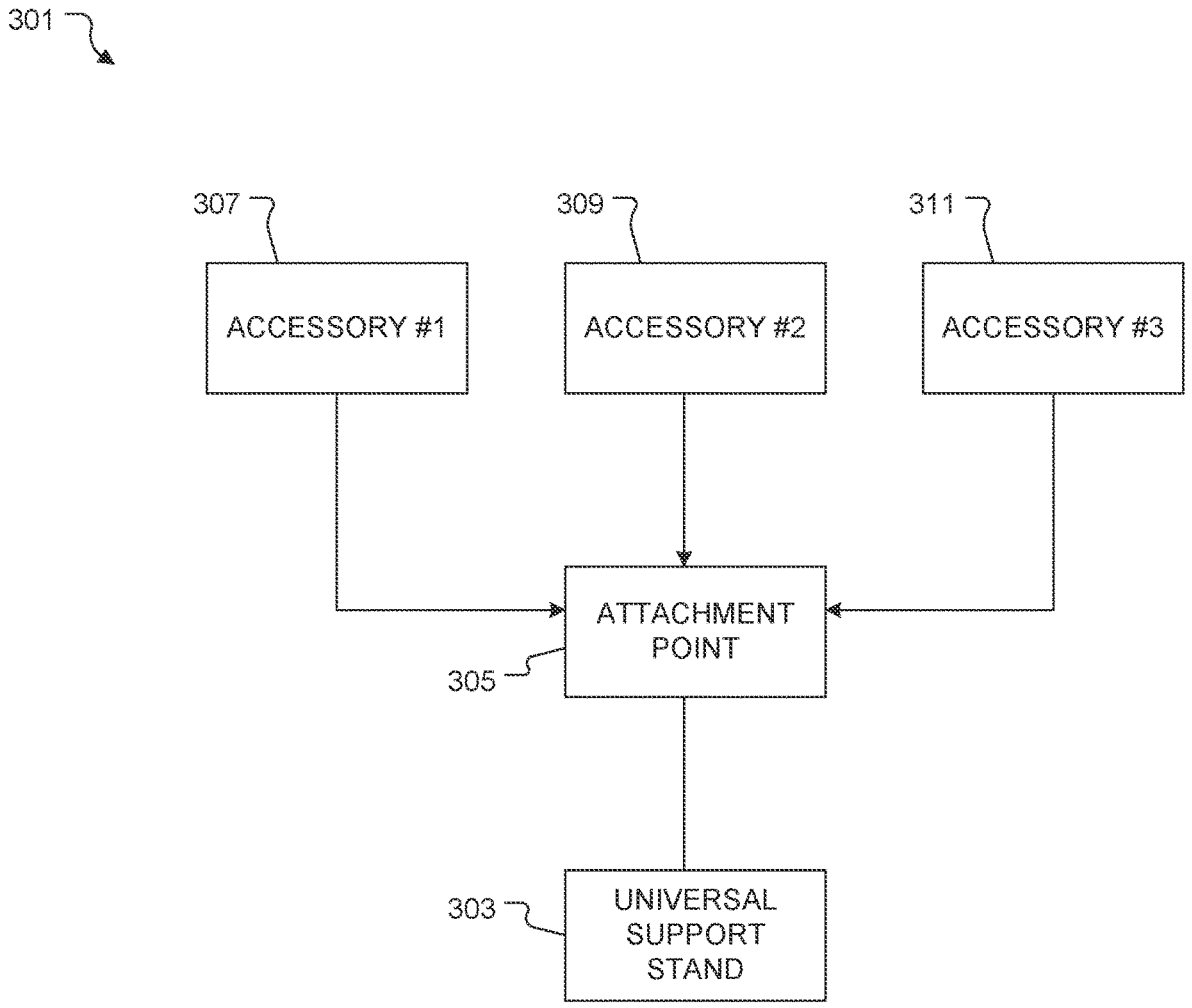
FIG. 3 is a diagram of an alternative embodiment of the changeable accessory stand of FIGS. 1A and 1B.

Referring now to FIG. 3, an alternative embodiment of the changeable accessory stand 103 is depicted. Embodiment 301 includes a universal support stand 303 with an attachment point 305. The attachment point 305 is configured to hold a series of accessories depicted as 307, 309 and 311. The accessories could be an umbrella, a music device, mister, fan or the like.

Figure 4:
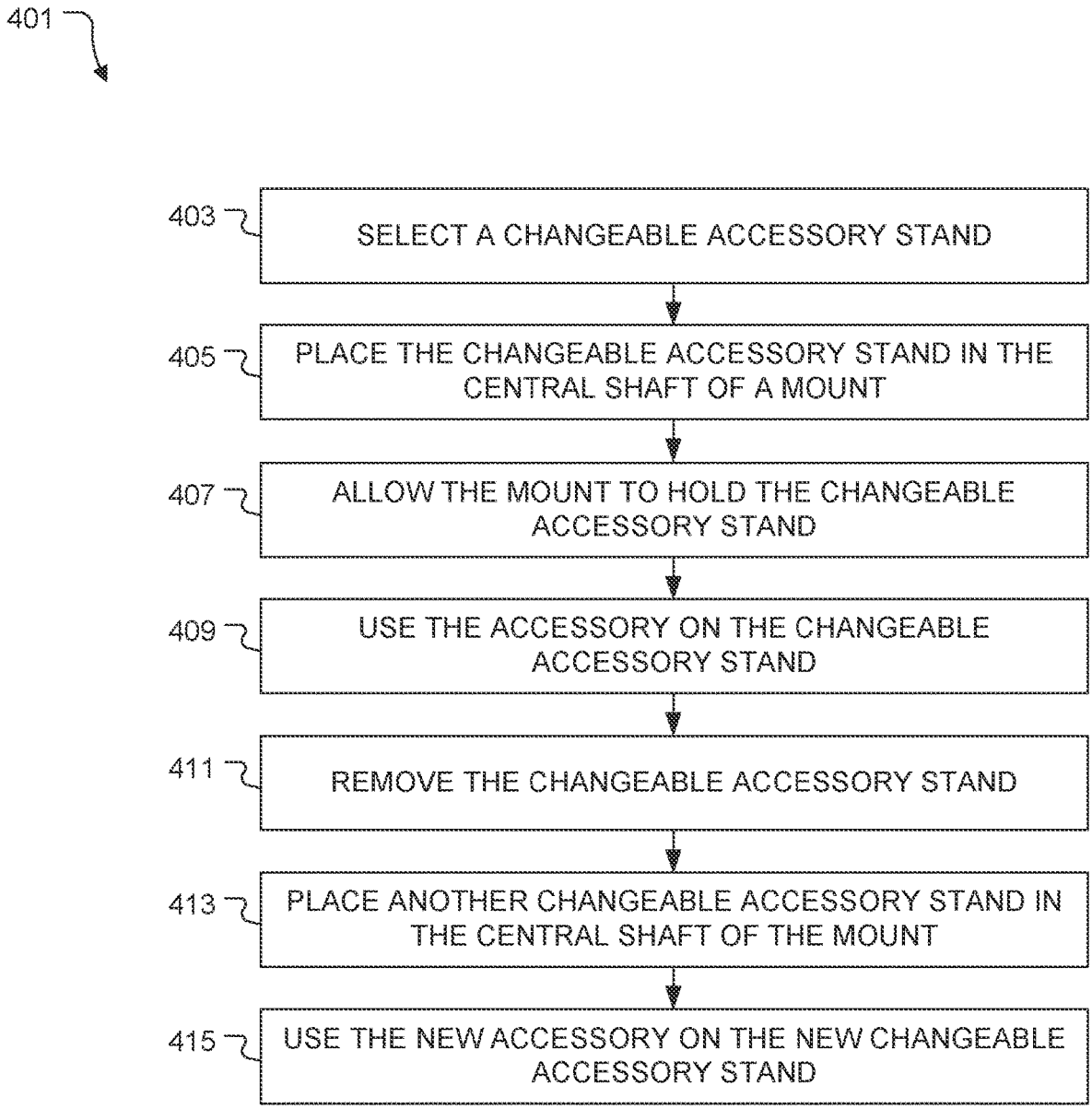
FIG. 4 is a flowchart of a method of use for a table.

Referring now to FIG. 4 a method of using a table is depicted. Method 401 includes selecting a changeable accessory stand 403, placing the changeable accessory stand in the central shaft of a mount 405, allowing the mount to hold the changeable accessory stand 407, using the accessory on the changeable accessory stand 409, removing the changeable accessory stand 411, placing another changeable accessory stand in the central shaft of the mount 413 and using the new accessory on the new changeable accessory stand 415.

Figure 5:
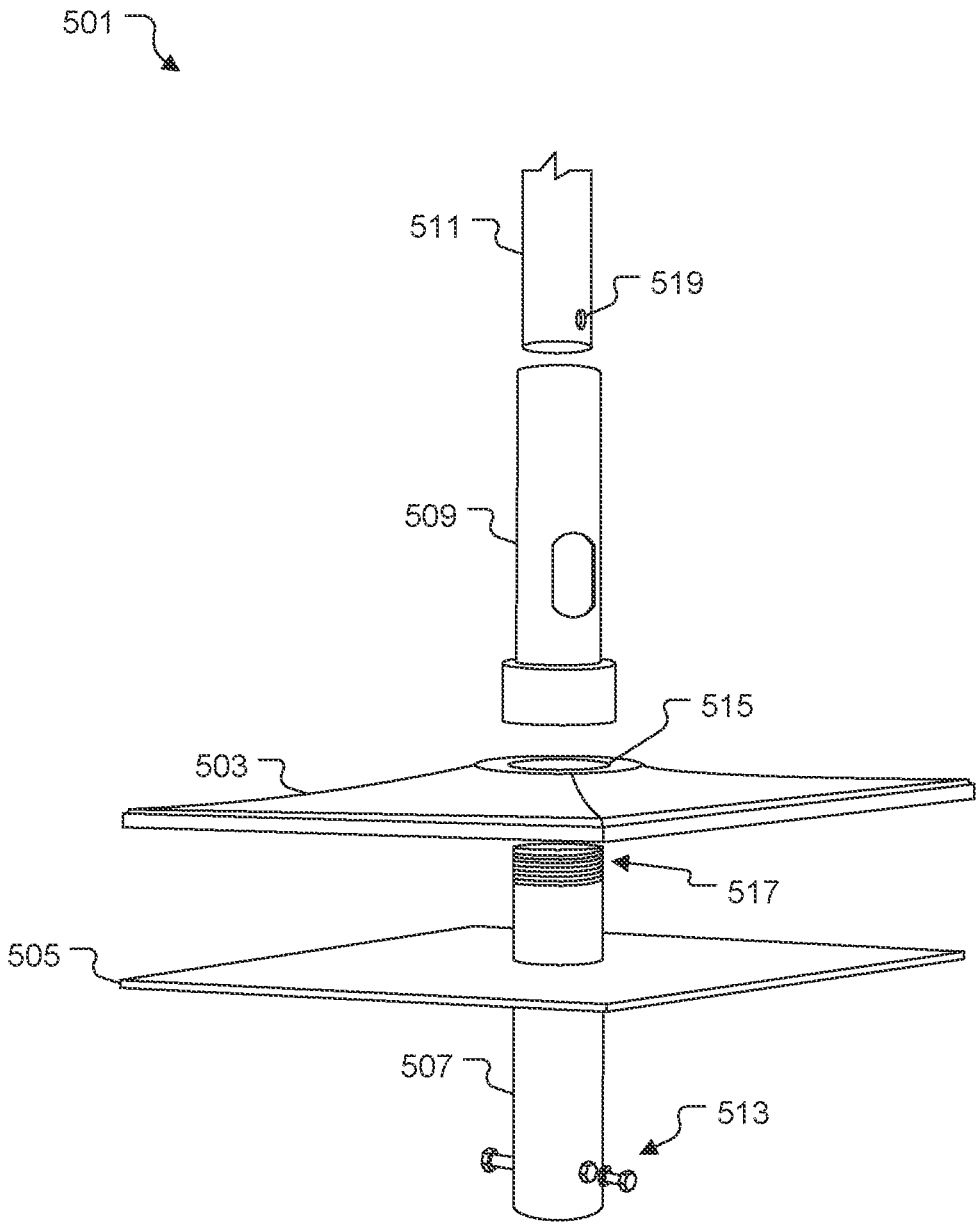
FIG. 5 is a front isometric view of an alternative embodiment of the system of FIGS. 1A and 1B.

Referring now to FIG. 5 an alternative embodiment of the system 101 is depicted. Embodiment 501 includes a mount body 503 with a passageway 515 passing therethrough to accommodate the central shaft 507 of a mounting plate 505. A mounting cap 509 is configured to pass over the end 517 of the central shaft 507. The hollow pole 511 for the accessory passes through the mounting cap 509, the passageway 515 of the mount body 503 and the central shaft 507 of the mounting plate 505 where it is secured via fasteners 513 and hole 519. It will be understood that the mount body 503 and mounting cap 509 increase the stability of the system and the accessory attached to a table thereby.

Figure 6:
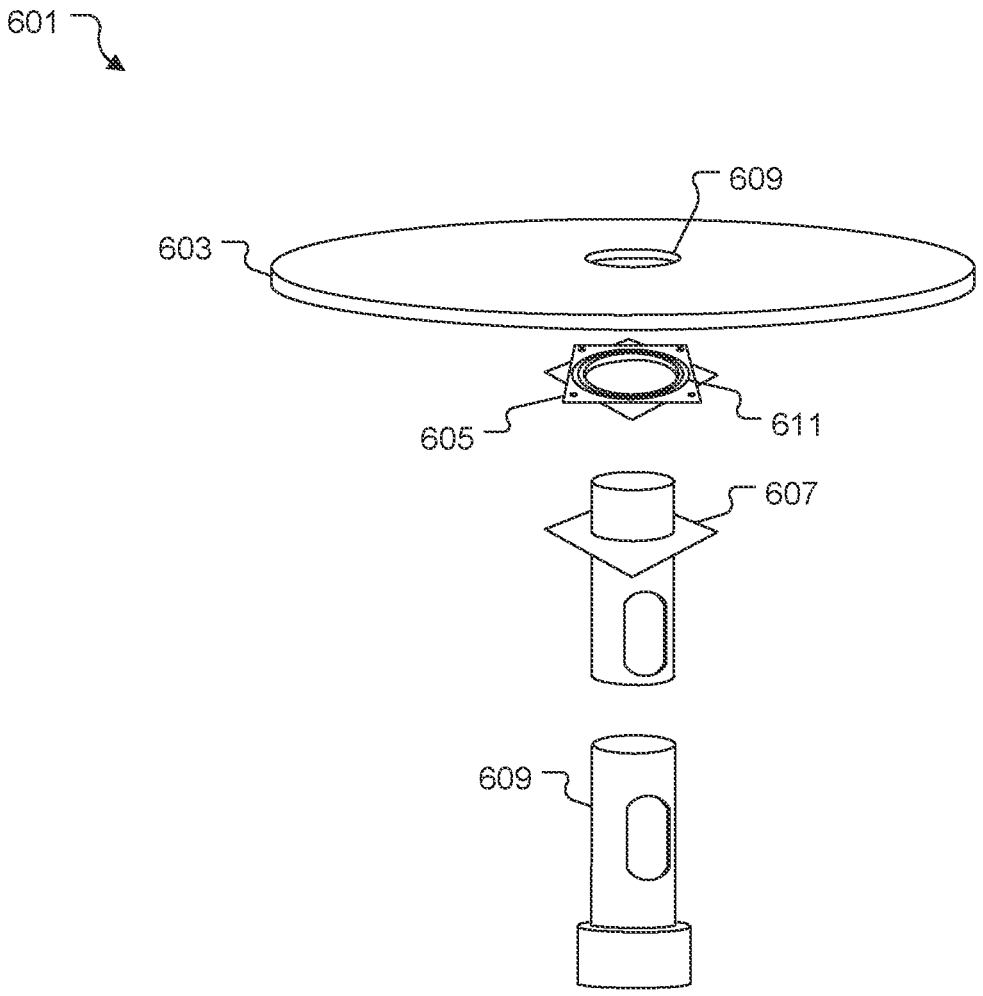
FIG. 6 is a front isometric view of an alternative embodiment of the system of FIG. 5.

It is contemplated, as depicted by FIG. 6 that accessories could be attached near the mount body. For example, a lazy-Susan top 603 is attached via a lazy-Susan bearing 605 to a tube-mounted plate 607. The tube-mounted plate 607 is configured to rest in a mounting cap 609. The lazy-Susan top 603 and lazy-Susan bearing 605 have a passageway 609 and 611 respectively, therethrough to accommodate the hollow pole of an accessory. It will be appreciated that in this manner an accessory such as a heater could be attached along with a lazy-Susan.

Figure 7:
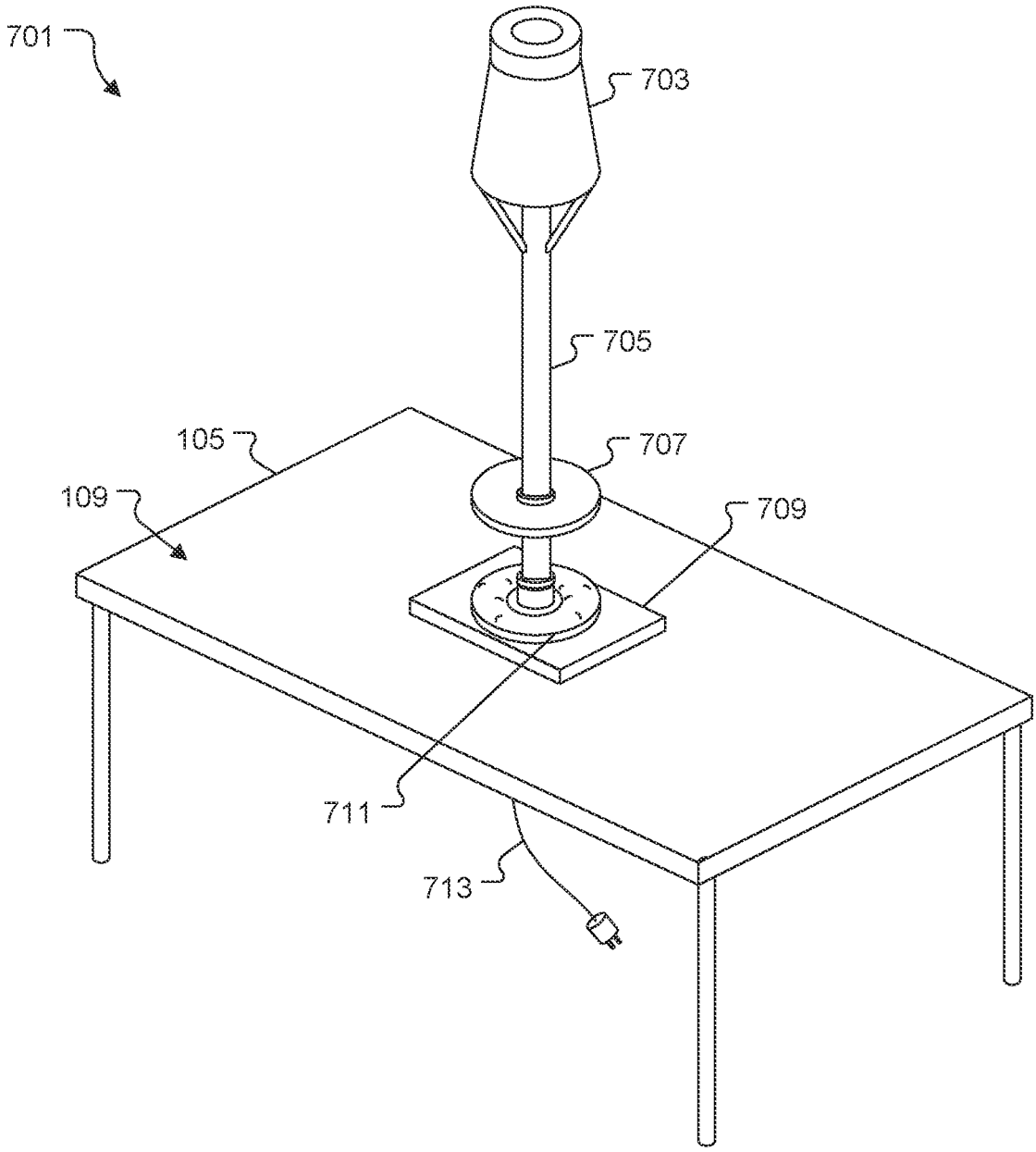
FIG. 7 is a top isometric view of an alternative embodiment of a table mount system in accordance with the present application.

Referring now to FIG. 7 an alternative embodiment of the system is depicted. Embodiment 701 includes a torch 703 that is a changeable accessory where it is attached to a shaft 705. The shaft 705 attaches to a mount 709. In this embodiment a speaker 711 or another secondary device is attached to the mount 709. The mount further supports an accessory 707 such as the lazy-Susan depicted here. It is contemplated that the speaker 711 or torch 703 could use electricity and that this is supplied through the hollow of the shaft 705 through cables 713 or cords.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A table mount system for a table having a passageway through a thickness extending from a top surface and a bottom surface, the system comprising:

at least one mount body configured to rest on the top surface;

at least one mounting plate configured to secure against the bottom surface, the at least one mounting plate having a shaft that extends through the passageway and through the mount body;

a fastener that extends through the thickness of the table and is configured to secure the mount body to the mounting plate;

wherein the mount and mounting plate attached on opposite sides of the top surface of a table;

at least one changeable accessory stand that includes;

a universal support stand;

at least one attachment points; and at least one accessory; and an attachment device that extends through the shaft and is configured to releasably secure the support stand to the shaft;

wherein the mount allows for the placement and support of the changeable accessory stand; and wherein the changeable accessory stand allows for the accessories to be interchangeably attached thereto.

* * * * *